United States Patent [19]

Starr

[11] 4,284,017

[45] Aug. 18, 1981

[54] ROTARY HOOK FOR SEWING MACHINE

[76] Inventor: Wayne E. Starr, 71 Water St., Portsmouth, R.I. 02874

[21] Appl. No.: 52,793

[22] Filed: Jul. 2, 1979

Related U.S. Application Data

[63] Continuation-in-part of Ser. No. 924,141, Jul. 13, 1978, abandoned.

[51] Int. Cl.[3] ..... D05B 57/08

[52] U.S. Cl. ..... 112/181; 112/228

[58] Field of Search ..... 112/228, 229, 231, 181, 112/302

[56] References Cited

U.S. PATENT DOCUMENTS

| | | | |
|---|---|---|---|
| 38,447 | 5/1863 | Grote | 112/184 |
| 1,966,432 | 7/1934 | Allen et al. | 112/228 X |
| 2,690,726 | 10/1954 | Wener | 112/231 |
| 2,830,550 | 4/1958 | Attwood et al. | 112/181 |
| 3,476,068 | 11/1969 | Preston | 112/181 |
| 4,009,670 | 3/1977 | Mitchell | 112/231 |

FOREIGN PATENT DOCUMENTS

| | | | |
|---|---|---|---|
| 50727 | 2/1890 | Fed. Rep. of Germany | 112/181 |
| 2169 | of 1865 | United Kingdom | 112/181 |
| 700306 | 11/1953 | United Kingdom | 112/181 |
| 747528 | 4/1956 | United Kingdom | 112/231 |

*Primary Examiner*—Wm. Carter Reynolds
*Attorney, Agent, or Firm*—Joseph Zallen

[57] ABSTRACT

A rotary hook and bobbin assembly for a lock-stitch sewing machine. The bobbin has no case but has a flat end plate and a convexly curved end plate. The bobbin holder has a post with a means for locking the bobbin and a relatively wide undergroove in its wall for adjusting tension.

4 Claims, 13 Drawing Figures

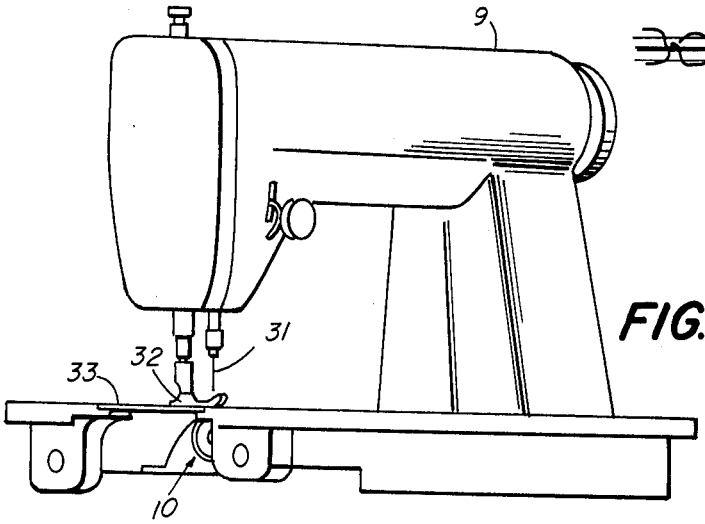
FIG. 1
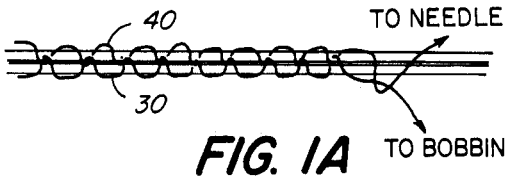
FIG. 1A
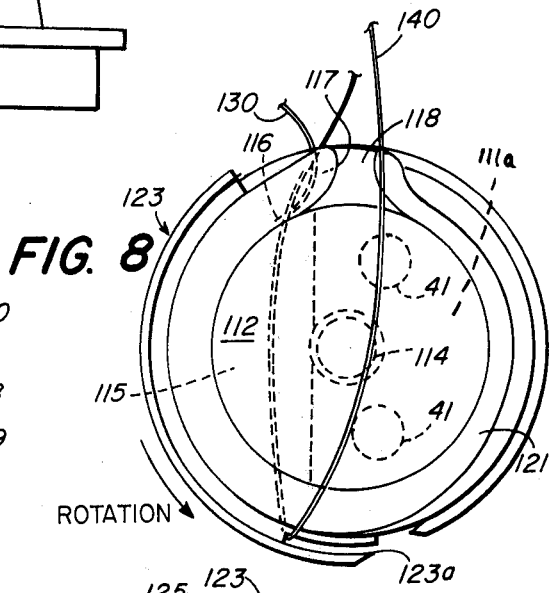
FIG. 8
FIG. 9
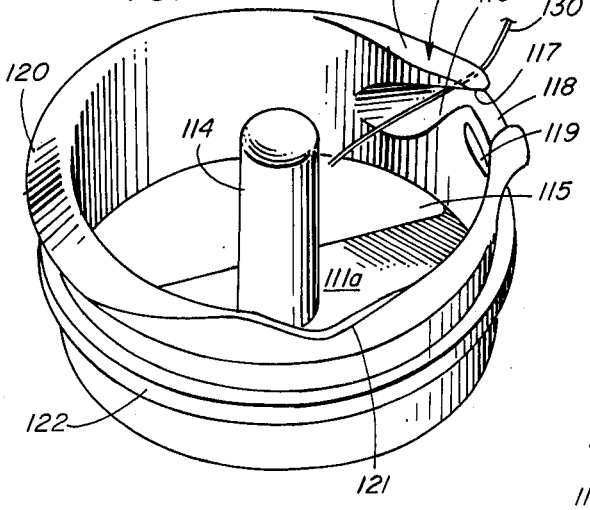
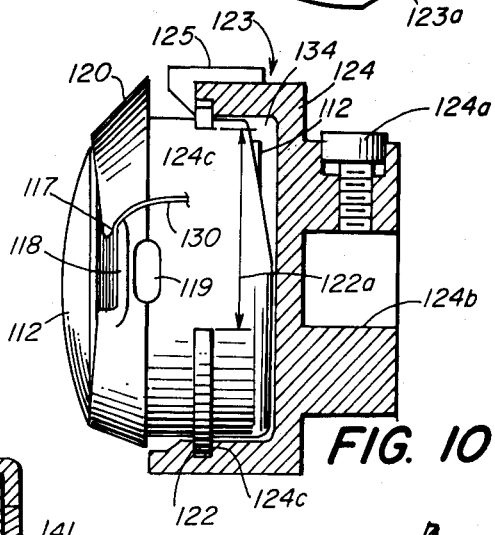
FIG. 10
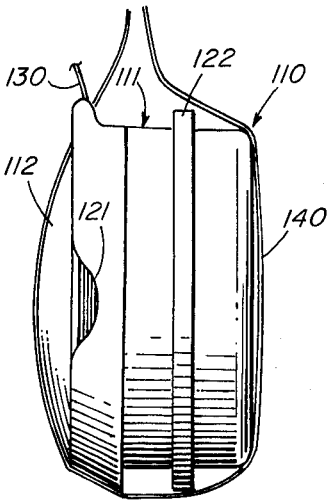
FIG. 11
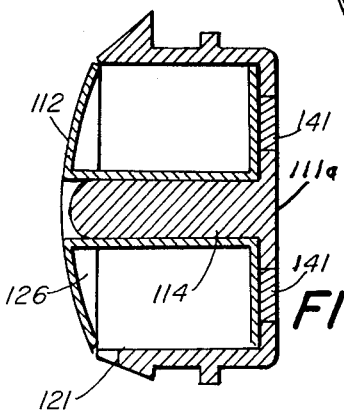
FIG. 12
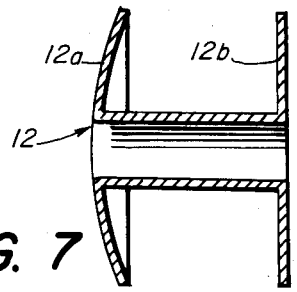
FIG. 7

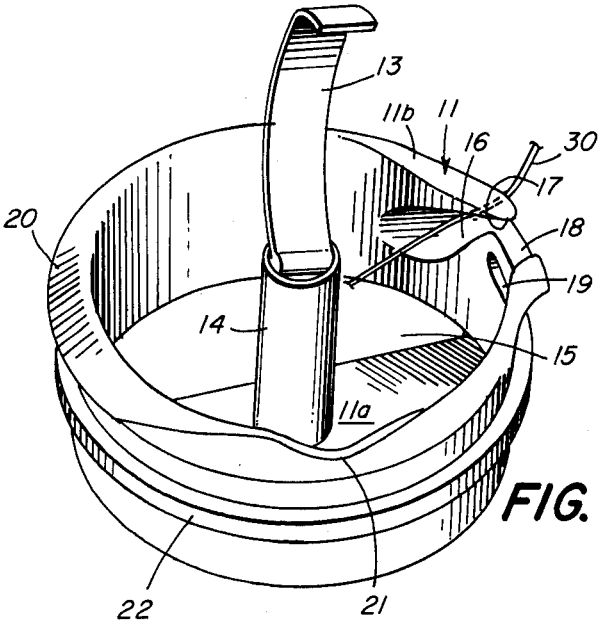
FIG. 3
FIG. 2
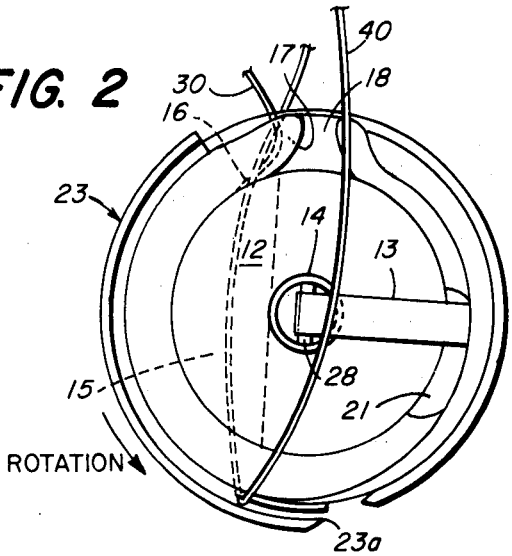
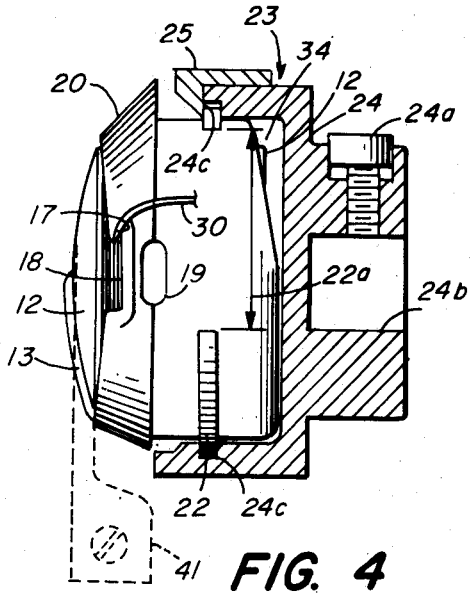
FIG. 4
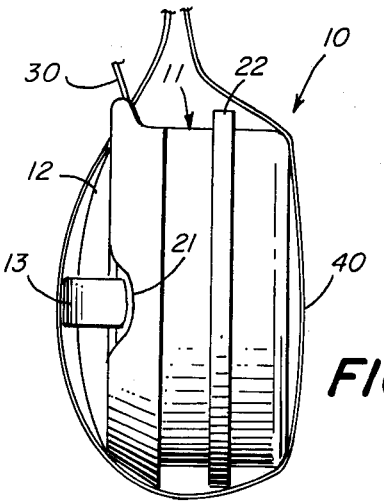
FIG. 5
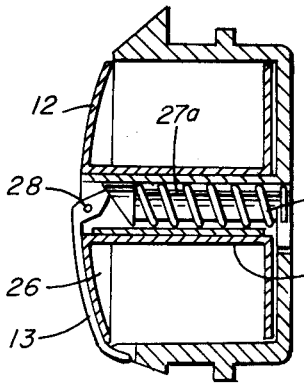
FIG. 6

ROTARY HOOK FOR SEWING MACHINE

This is a continuation-in-part of pending application Ser. No. 924,141 filed July 13, 1978, now abandoned.

BACKGROUND OF INVENTION

This invention relates to lock-stitch sewing machines. In particular, it relates to a rotary hook for single-needle lock-stitch sewing machines.

Examples of prior art in rotary hook sewing machines can be found in U.S. Class 112, Subclass 231 of the U.S. Patent Classification System. Pertinent prior art includes U.S. Pats. Nos. 1,966,432, 2,830,550, 3,476,068 and 4,009,670, German Pat. No. 50727 and British Pat. No. 700,306. The prior art uses the standard bobbin having identical end plates and has one or more problems such as "stalling" of thread, low capacity, difficulty in threading, and difficulty in maintaining the appropriate tension.

One object of this invention is to provide a hook and bobbin assembly having higher thread capacity, ease of threading, self-adjusting tension, less stalling, and higher speed than the prior art.

Further objects and advantages of this invention will be apparent from the description and claims which follow taken together with the appended drawings.

SUMMARY OF INVENTION

The invention comprises generally a rotary hook and bobbin assembly for a lock-stitch sewing machine having a rotary driving shaft. The assembly is located in the same position in a single needle lock-stitch sewing machine as other rotary hook-bobbin assemblies in the prior art. In the specific examples which follow, the invention is illustrated with reference to undertrimming, but can be used with other single-needle lock-stitch sewing machines.

The principal features of the rotary hook-bobbin assembly are found in the novelty of the bobbin shape and in the particular structure of the holder for the bobbin. The bobbin of this invention is characterized as having no case, but having a central rod in which the thread is wound, a flat end plate on one side and a convexly curved end plate on the other side. The central rod is hollow so that it can be mounted for free spinning on a post in the holder.

The holder post is characterized in one form as having a curved spring-loaded locking arm which curves from the top of the post and snaps onto an indentation on the upper part of the casing. A portion of the top edge of the holder wall is beveled with the result that the curved arm, beveled surface and curved and unobstructed end plate of the bobbin provide a continuous curved surface for the travel of the needle thread around the holder to catch the bobbin thread in forming the stitch. It should be noted that the needle thread completely surrounds the holder to catch the bobbin thread in forming the stitch.

In another form of this invention the bobbin has a ferromagnetic flat end plate and the holder portion adjacent that plate contains spaced magnets of sufficient force so as to hold the bobbin in position on the post but permit it to rotate freely. In this form of the invention, as in the prior prescribed form the beveled surface and curved end-plate of the bobbin provide a continuous curved surface for the travel of the needle thread around the holder.

In both forms of this invention there is a provision for a relatively wide undergroove at the bobbin thread exit portion near the needle opening. Automatic tension control for the bobbin thread is provided by the combination of the continuous curved surface, the undergroove and the flat surface of the bobbin. The flat side of the bobbin makes total contact with the back wall of the holder, with the curved end out. As the bobbin thread is drawn off the bobbin the bobbin spins in a clockwise direction which is opposite to the counterclockwise rotation of the assembly. This permits the bobbin to thread itself in the holder. The operator simply puts in a bobbin and starts to sew, with no need to pick up the bobbin thread manually as in previous hook assemblies. The opposite directions of rotation provide intertial balance and smooth, quiet operation.

The forces on the holder would tend to make the holder rotate in the same direction as the bobbin. This occurs when thread is drawn off the bobbin in short pulses as each stitch is formed. However since the assembly rotates in a counterclockwise direction the forces on the holder would tend to make it rotate in the same direction. At sewing speeds the opposing forces tend to cancel leaving the holder neutral and stable, thus enabling improved stitches to be formed.

BRIEF DESCRIPTION OF DRAWINGS

FIGS. 1, 1A and 7 refer to the invention generally, while FIGS. 2–6 refer to one embodiment and FIGS. 8–12 refer to a second embodiment of this invention.

FIG. 1 is a perspective view in semi-diagrammatic form of a single needle lock-stitch sewing machine using undertrimming, showing where the rotary hook and bobbin assembly of this invention would be installed.

FIG. 1A is a diagrammatic view of the interlocking of the bobbin thread and needle thread.

FIG. 2 is a plan view of the front portion showing a bobbin in place and indicating the position of the bobbin thread and needle thread.

FIG. 3 is a perspective view of the bobbin holder with the bobbin removed and the arm up.

FIG. 4 is a top view with partial sectioning showing attachment of the assembly to a sewing machine.

FIG. 5 is a side view in a different position.

FIG. 6 is a section through the assembly.

FIG. 7 is a side sectional view of the bobbin.

FIG. 8 is a plan view of the front portion of the second embodiment.

FIG. 9 is a perspective view of the bobbin holder with the bobbin removed.

FIG. 10 is a top view with partial sectioning showing attachment of the assembly to a sewing machine.

FIG. 11 is a side view in a different position.

FIG. 12 is a section through the assembly.

SPECIFIC EXAMPLES OF THE INVENTION

Referring now to the drawings, there are illustrated therein two embodiments of the rotary hook-bobbin assembly of this invention as applied to an undertrimming, lock-stitch sewing machine.

Embodiment of FIGS. 2–6

The sewing machine 9 has a conventional reciprocating needle 31 which extends through the pressure foot 32 and bottom plate 33 into the assembly 10 through needle opening 19.

The assembly 10 of the bobbin holder 11 and bobbin 12 are attached to the machine by a holding means 23 which consists of a removable plate 25 and a cup portion 24. The cup portion 24 has a back opening 24*b* to receive the rotary driving shaft (not illustrated) and hold it by means of bolt 24*a*. Cup portion 24 also has a raceway 24*c* which cooperates with the ridge 22 of the holder 11 to hold it in position. The removable portion 25 permits the insertion and locking of the holder 11 with its ridge into the groove.

The holder 11 has a center hollow post 14 on which the bobbin 12 is mounted. The holder 11 has a ridge 22 for mounting the holding means 23, an upper, rear beveled surface 20, a needle opening 19, a finger 17, a relatively wide undergroove 16 in which the bobbin thread moves, an opening 18 which is engageable with the positioner 41 which is normally attached to the sewing machine, and a floor 11*a* in which there is an opening 15.

The center post 14 of the holder has a spring 27 held with locking rod 27*a* against arm 13 which pivots on rod 28. Arm 13 is curved so as to register with the curvature of end wall 12*a* of bobbin 12 and it extends over the bobbin so as to lock into groove 21 in the holder. The other end wall 12*b* of the bobbin 12 is flat and seats against the bottom wall 11*a* of the holder 11.

In operation, the needle 31 goes down and after reaching its lowest point on the downward stroke forms a little loop as it rises. This loop of needle thread 40 is picked up by the point of the hook 23*a* (FIG. 2) and carried around the holder 11 (FIG. 5) and then draws the bobbin thread up to form the proper stitch. As indicated in FIG. 4, the ridge 22 has an interruption 22*a* to permit the smooth flow of the needle thread around the holder. As the holder means 23 rotates in synchronization with the needle, the bobbin holder 11 is held in fixed position by the sewing machine positioner 41 but the bobbin 12 is free to rotate.

It should be noted that the bobbin has no case and that the spring-held, curved arm cooperates in forming the nonsnagging surface for the needle thread. No adjustments are needed for changing from one thickness of thread to another. The tension is directly on the bobbin and regardless of any bumps or the like that might be in the thread, the tension is automatically self adjusted by the drag caused by the arm and the frictional engagement of the thread on the undergroove 16.

To change or insert a bobbin, the arm 13 of the holder is raised. The bobbin 12 wound with a supply of bobbin thread 30, is placed on the post 14 with its flat side 12*b* against the inner wall 11*a* of bobbin holder 11, convexly curved wall 12*a* being outward. Arm 13 is then lowered into locked position with a sufficient amount of bobbin thread 30 left hanging out of the holder so as to be engagable with needle thread 30. At the beginning of the sewing operation rotation of the hook 23 catches the needle thread 40 and causes it to go around the holder and engage bobbin thread 30, moving it into undergroove 16 where it remains. The bobbin thread is thus self-threading in the sewing machine. It should be noted that bobbin thread 30 passes without obstruction from the bobbin 12 to contact the undergroove 16 and pass therefrom outwardly of the holder 11. In the prior art bobbin threading required manual manipulation around and through obstructions such as springs and casings.

Embodiment of FIGS. 8–12

In the embodiment represented by FIGS. 8 to 12 the bobbin 112 is of the same configuration having a curved outer wall 112*a* and a flat inner wall 112*b*. However, in this case the bobbin must be made of ferro-magnetic material at least with respect to wall 112*b*.

The assembly 110 of the bobbin holder 111 and bobbin 112 are attached to the machine by a similar holding means 123 which consists of a removable plate 125 and a cup portion 124. The cup portion 124 has a back opening 124*b* to receive the rotary driving shaft (not illustrated) and hold it by means of a bolt 124*a*. Cup portion 124 also has a raceway 124*c* to latch 122 of the holder 111 to hold it in position. The removable portion 125 permits the insertion and locking of the holder 111 when it is latched into the groove. The holder 111 has a center solid post 114 on which the bobbin 112 is mounted. The holder 111 has a (ridge) 122 for mounting the holding means 124, an upper rear beveled surface 120, a needle opening 119, a finger 117, a relatively wide undergroove 116 in which the bobbin thread moves, an opening 118 which is engageable with the finger position 141 which is normally attached to the sewing machine and floor 111*a* in which there is an opening 115.

The floor 111*a* of holder 111 has two magnetic discs 141. A suitable magnetic disc would be a rare earth cobalt magnet of the order of 3/16 inches in diameter with an energy product of fifteen million gauss-oersteds and having a composition of approximately 65% cobalt and 35% samarium. Sources of such rare earth magnets include Emm Indiana General, a division of Electronic Memories and Magnetics Corp. of Valpariso, Ind., Crucible Magnetics Division of Colt Industries, Elizabethtown, Ky. and Hitachi Magnetics Corp. of Edmore, Mich. The bobbin 112 is held on the holder 111 by the magnetic forces of the discs 141 and thus provides the tension for the bobbin thread. The bobbin 112 is removed from the holder 111 by inserting a finger into the slot 121 and pulling forward.

The operation of this embodiment is similar to that of the preceding embodiment.

I Claim:

1. A bobbin assembly for a single needle lockstitch sewing machine having a rotary driving shaft; said assembly being engagable with a rotary hook (23); said rotary hook (23) being mountable one said shaft; said assembly comprising a bobbin holder (11) mounted on said hook (23) for rotational movement of said hook relative thereto and having a bottom wall (11*a*) and a bobbin (12) having a convexly curved outer end plate (12*a*) and a flat inner end plate (12*b*) seated within said holder (11) with said flat end plate (12*b*) being against said bottom wall 11*a*;

(a) said holder (11) having a needle opening (19), an opening (18) for positioning said holder (11) on the sewing machine positioner (41), a relatively wide undergroove (16) spaced adjacent said opening (18), a beveled surface (20), a bobbin post (14) on which said bobbin (12) is mounted, and means (13) for applying force axially on a said bobbin so as to drive and maintain said flat bobbin end plate (12*b*) in frictional contact with said bottom wall (11*a*); a bobbin thread (30) passing without obstruction from said bobbin (12) to contact said undergroove (16) and pass therefrom outwardly of said holder (11).

(b) said bobbin (12) being freely rotatable on said bobbin post (14); said convexly curved outer end plate (12*a*) directly contacting and supporting needle thread (40) when said needle thread (40) is looped around said holder (11); said bobbin being characterized as being self-threading within said assembly (11) when mounted on said post;

whereby said needle thread (40) is wrapped aroung said bobbin holder (11), said beveled surface (20), and said curved bobbin plate (12*a*) to form a uniform stitch with the self-adjusting tension pull of the bobbin thread (30); the tension of said bobbin thread (30) being maintained constant by the force exerted by said force means (13) on said bobbin in conjunction with said relatively wide undergroove (16).

2. The assembly of claim 1 wherein said means (13) for applying force axially on said bobbin comprises a curved spring-loaded arm means which conforms to the curvature of said bobbin end plate (12*a*).

3. The assembly of claim 1 wherein the means 13 for applying force axially on said bobbin comprises magnetic means (141).

4. The assembly of claim 3 wherein said magnetic means comprises magnetic discs in the floor (111*a*) of the bobbin holder.

* * * * *